US007351671B2

(12) United States Patent
Adachi et al.

(10) Patent No.: US 7,351,671 B2
(45) Date of Patent: Apr. 1, 2008

(54) UNION FABRIC WITH FLAME RESISTANCE

(75) Inventors: Masayuki Adachi, Hyogo (JP); Takaharu Matsumoto, Hyogo (JP); Masanobu Tamura, Osaka (JP)

(73) Assignee: Kaneka Corporation, Osaka (JP)

( * ) Notice: Subject to any disclaimer, the term of this patent is extended or adjusted under 35 U.S.C. 154(b) by 0 days.

(21) Appl. No.: 10/508,886

(22) PCT Filed: Mar. 20, 2003

(86) PCT No.: PCT/JP03/03397

§ 371 (c)(1),
(2), (4) Date: Sep. 23, 2004

(87) PCT Pub. No.: WO03/080908

PCT Pub. Date: Oct. 2, 2003

(65) Prior Publication Data

US 2005/0148256 A1 Jul. 7, 2005

(30) Foreign Application Priority Data

Mar. 25, 2002 (JP) ..... 2002-082710

(51) Int. Cl.
*D03D 15/12* (2006.01)

(52) U.S. Cl. ..... 442/209; 442/189; 442/197; 442/199; 442/203; 442/301; 442/302; 428/920; 428/921

(58) Field of Classification Search ..... 442/197, 442/199, 203, 209, 301, 302, 189; 428/920, 428/921

See application file for complete search history.

(56) References Cited

U.S. PATENT DOCUMENTS 4,863,797 A * 9/1989 Ichibori et al. ..... 428/359
5,104,703 A * 4/1992 Rachman et al. ..... 428/35.6
5,348,796 A * 9/1994 Ichibori et al. ..... 442/202
5,587,118 A * 12/1996 Mallonee ..... 264/78
6,335,093 B1 * 1/2002 Mori et al. ..... 428/370
6,524,691 B2 * 2/2003 Sugawara et al. ..... 428/292.4

FOREIGN PATENT DOCUMENTS

JP 2593985 B2 12/1996
JP 2593986 B2 12/1996
JP 9-296335 A 11/1997
JP 10-140478 A 5/1998

* cited by examiner

*Primary Examiner*—Andrew T Piziali
(74) *Attorney, Agent, or Firm*—Brinks Hofer Gilson & Lione

(57) ABSTRACT

A fabric is provided that has high degree of flame resistance in the case of a union fabric consisting of a halogen-containing flame resistant fiber including antimony compounds, and a cellulosic fiber, and the fabric is classified into class M1 of NF P 92-503 combustion test in France. A flame resistant union fabric obtained by co-weaving: (A) a fiber yarn 30% to 70% that has, as a principal component, a halogen-containing flame resistant fiber including an antimony compound 25 parts to 50 parts in an acrylic based copolymer 100 parts consisting of acrylonitrile 30% to 70% by weight, a halogen containing vinyl based monomer 30% to 70%, and a vinyl based monomer copolymerizable therewith 0% to 10%; and (B) a compound yarn 70% to 30% consisting of a cellulosic fiber (b-1) and a fiber melting at temperatures of 200 degrees C. to 400 degrees C. (b-2).

3 Claims, No Drawings

UNION FABRIC WITH FLAME RESISTANCE

RELATED APPLICATIONS

This application is a nationalization of PCT Application No. PCT/JP03/03397 filed Mar. 20, 2003. This application claims priority from Japanese Patent Application No. 2002-82710 filed on Mar. 25, 2002.

FIELD OF THE INVENTION

The present invention relates to a flame resistant union fabric. Specifically, the present invention relates to a union fabric having high degree of flame resistance consisting of: a halogen-containing fiber including antimony compounds; and a compound yarn of a cellulose fiber and of a fiber melting at temperatures of 200 degrees C. to 400 degrees C.

BACKGROUND ART

In recent years, demand for guarantee of safety of foods, clothes and housings has become stronger, and necessity for fire-resistant material is increasing. In such a situation, a plurality of methods to give flame resistance to a flammable yarn by compounding general-purpose flammable fibers and flame resistant fiber shaving high degree of flame resistance, while maintaining characteristics of the flammable yarn, have been proposed. As such a compound fiber, for example, Japanese Patent No. 2593985 specification and Japanese Patent No. 2593986 specification disclose a method of using antimony compounds as a flame resistant agent to be added to halogen-containing flame resistant fibers in compounding of halogen-containing flame resistant fibers and natural fibers.

Recently, union fabrics using general-purpose cellulosic fibers as a warp yarn and a halogen-containing flame resistant fiber including antimony compounds as a weft yarn are often used for interior design products, such as curtains and chair coverings, because special features of cellulosic fibers, such as natural feeling, hygroscopic property, and heat resistance, can be exhibited. Among them, union fabrics using cellulosic fibers as a warp yarn and halogen-containing flame resistant fibers including antimony compounds as a weft yarn, such as jacquard, dobby, and satin have special feature with many cellulosic fibers disposed on a surface side of the fabric.

However, in these union fabrics, uneven existence of cellulosic fibers and halogen-containing flame resistant fibers in a fabric makes it very difficult to pass a highest flame resistant class M1 in NF P 92-503 combustion test in France that requires a very high degree of flame resistance.

Only international publication No. 01/32968 pamphlet proposes a method applying such technique furthermore in which a union fabric using a cellulosic fiber as a warp yarn and a halogen-containing fiber having an antimony compound and a zinc stannate compound added therein in combination as a weft yarn has a very high flame resistance passing class M1 of NF P 92-503 combustion test.

However, since zinc stannate compounds have a higher cost than that of antimony compounds, the fiber has a cost higher than that of conventional fibers as compared with independent addition of the antimony compounds to the halogen-containing fiber, leading to a problem of higher cost of the union fabric.

Accordingly, in a union fabric comprising a halogen-containing fiber by addition of only antimony compounds and a general-purpose fiber, such as a cellulosic fiber, development of a union fabric exhibiting high flame resistance and classified in Class M1 of NF P 92-503 combustion test without combined use of zinc stannate compounds etc. has been long awaited.

The present invention aims at providing a fabric having high degree of flame resistance in case of union fabrics consisting of halogen-containing flame resistant fibers and cellulosic fibers, and classified in class M1 of NF P 92-503 combustion test.

SUMMARY OF THE INVENTION

The present inventors performed repeated investigation about union fabrics consisting of modacrylic flame resistant fibers as halogen-containing flame resistant fibers, and cellulosic fibers. And as a result, it was found out that use of a modacrylic fiber including a antimony compound, a specified amount of a compound yarn of a cellulosic fiber and a melting fiber might exhibit high flame resistance, in union fabrics, such as jacquard, dobby, and satin weave.

That is, the present invention relates to a flame resistant union fabric obtained by co-weaving: (A) a fiber yarn 30% to 70% that has, as a principal component, a halogen-containing flame resistant fiber including an antimony compound 25 parts to 50 parts in an acrylic based copolymer 100 parts (hereinafter abbreviated as simply part) consisting of acrylonitrile 30% to 70% by weight (hereinafter abbreviated as simply %), a halogen containing vinyl based monomer 30% to 70%, and a vinyl based monomer copolymerizable therewith 0% to 10%; and a compound yarn (B) 70% to 30% consisting of a cellulosic fiber (b-1) and a fiber melting at temperatures of 200 degrees C. to 400 degrees C. (b-2).

The flame resistant union fabric is preferably of a union fabric wherein the cellulosic fiber (b-1) is at least one kind selected from a group consisting of cotton, hemp, rayon, polynosic, cupra, acetate and triacetate.

BEST MODE FOR CARRYING-OUT THE INVENTION

The present invention relates to a flame resistant union fabric obtained by co-weaving: a fiber yarn (A) 30% to 70% that has, as a principal component, a halogen-containing flame resistant fiber including an antimony compound 25 parts to 50 parts in an acrylic based copolymer 100 parts consisting of acrylonitrile 30% to 70% by weight, a halogen containing vinyl based monomer 30% to 70%, and a vinyl based monomer copolymerizable therewith 0% to 10%; and a compound yarn (B) 70% to 30% consisting of a cellulosic fiber (b-1) and a fiber melting at temperatures of 200 degrees C. to 400 degrees C. (b-2).

In the present invention, a fiber yarn including a halogen-containing flame resistant fiber (A) (hereinafter referred to as also fiber yarn (A)) as a principal component is a fiber that is used in order to give flame resistance to a union fabric of the present invention. A halogen-containing flame resistant fiber as a principal component of the fiber yarn (A) consists of a composition including an antimony compound in an acrylic based copolymer obtained by polymerization of a monomer mixture including acrylonitrile 30 to 70%, a halogen containing vinyl based monomer 30 to 70%, and a vinyl based monomer (hereinafter referred to as copolymerizable vinyl based monomer) 0% to 10% copolymerizable with the acrylonitrile and the halogen including vinyl based monomer.

In the monomer mixture used for obtaining the acrylic based copolymer, a percentage of the acrylonitrile is not less than 30%, and preferably not less than 40% (lower limit), and it is not more than 70%, and preferably not more than 60% (upper limit).

In the monomer mixture, a percentage of the halogen containing vinyl based monomer is not less than 30%, and preferably not less than 40% (lower limit), and it is not more than 70%, and preferably not more than 60% (upper limit). In the monomer mixture, a percentage of the copolymerizable vinyl based monomer is not less than 0%, and preferably not less than 1% (lower limit), and it is not more than 10%, and preferably not more than 5% (upper limit).

Of course, a total percentage of the acrylonitrile, the halogen containing vinyl based monomer, and the copolymerizable vinyl based monomer is adjusted so as to give 100%.

In the monomer mixture, a percentage of the acrylonitrile of less than the lower limit or a percentage exceeding the upper limit of the halogen containing vinyl based monomer does not allow demonstration of sufficient heat-resistance, and a percentage exceeding the upper limit of the acrylonitrile unit or a percentage of the halogen containing vinyl based monomer of less than the lower limit gives inadequate flame resistance. In the monomer mixture, a percentage exceeding the upper limit of the copolymerizable vinyl based monomer fails to fully exhibit flame resistance and touch that are special feature of the halogen-containing flame resistant fiber.

Any halogen containing vinyl based monomers can be used, as long as the halogen containing vinyl based monomer is a vinyl based monomer including halogen atom, preferably bromine atom or chlorine atom. As examples of the halogen containing vinyl based monomer, for example, vinyl chloride, vinylidene chloride, vinyl bromide, etc. may be mentioned. These may be used independently or two or more kinds may be used in combination.

As the copolymerizable vinyl based monomer, for example, there may be mentioned: acrylic acid; acrylic esters, such as ethyl acrylate, and propyl acrylate; methacrylic acid; methacrylic esters, such as methyl methacrylate, and ethyl methacrylate; and furthermore, acrylamide, vinyl acetate, vinyl sulfonic acid, vinyl sulfonate (sodium vinyl sulfonate etc.), styrene sulfonic acid, styrene sulfonate (sodium styrene sulfonate etc.) These may be used independently or two or more kinds may be used in combination.

As methods of obtaining the acrylic based copolymer by polymerization of the monomer mixture including the acrylonitrile, halogen containing monomer, and the monomer copolymerizable therewith, any methods, such as usual vinyl polymerization methods, for example, a slurry polymerization method, an emulsion polymerization method, a solution polymerization method, etc., may be adopted without special limitation.

As preferable examples of the antimony compound, for example, inorganic antimony compounds, such as antimony trioxide, antimony pentoxide, antimonic acid, and antimony oxychloride may be mentioned. These may be used independently or two or more kinds may be used in combination.

A content of the antimony compound is not less than 25 parts to the acrylic based copolymers 100 parts, and preferably not less than 30 parts (lower limit), and it is not more than 50 parts (upper limit)

A content of the antimony compound of less than the lower limit disables sufficient guarantee of flame resistance of a flame resistant union fabric. And on the other hand, an amount of the antimony compound exceeding the upper limit reduces physical properties, such as strength and elongation, of the halogen-containing flame resistant fiber, leading to problems, such as nozzle clogging during manufacturing process.

As methods of adding the antimony compound, as a flame resistant agent, to the acrylic based copolymer to obtain a composition (halogen-containing flame resistant fiber), there may be mentioned: a method of dissolving the acrylic based copolymer in a solvent that can dissolve the copolymer and then of mixing and dispersing the flame resistant agent into the obtained solution to manufacture a fiber; and a method of immersing a fiber obtained from the acrylic based copolymer into a binder aqueous solution including a flame resistant agent and then squeezing, drying, and heat treating to impregnate the flame resistant agent using after treatment technique etc. Methods for obtaining a halogen-containing flame resistant fiber are not limited to them, and other well-known methods may be used.

Although the fiber yarn (A) is preferably obtained only from the halogen-containing flame resistant fiber, it may also include other fibers, including a halogen-containing flame resistant fiber as a principal component. "Principal component" here means including the component with at least 80% of content.

The compound yarn (B) consists of a cellulosic fiber (b-1), and a fiber melting at 200 degrees C. to 400 degrees C. (b-2).

The compound yarn (B) including the fiber melting at 200 degrees C. to 400 degrees C. (b-2) excels as compared with a case where a yarn without the yarn (b-2) is used, because the melting fiber (b-2) may cover around the halogen-containing flame resistant fiber to improve heat resistance of the fabric and flame resistance, and calorific power in contact to a heater flame may be controlled in combustion test of the fabric.

Compounding of the fibers is preferably performed to make total of 100 parts so that a content of the cellulosic fiber (b-1) is 95 to 75 parts, and preferably 90 to 80 parts, and the fiber melting at 200 degrees C. to 400 degrees C. (b-2) is 5 parts to 25 parts, and preferably 10 parts to 20 parts in the compound yarn (B). There is shown a tendency for a content of less than 75 parts of the cellulosic fiber (b-1) to reduce flame resistance.

There is shown a tendency for a content of the cellulosic fiber (b-1) exceeding 95 parts to cause flame resistant decrease accompanying heat-resistant decrease of the compound yarn (B). Although the cellulosic fiber (b-1) in particular is not limited, in view of fully exhibiting natural touch, at least one kind of yarns selected from a group consisting of cotton, hemp, rayon, polynosic, cupra, acetate, and triacetate are preferable. In view of many advantages, such as washing resistance, dye affinity, and low cost, especially cotton is preferable among them.

Although the fiber melting at 200 degrees C. to 400 degrees C. (b-2) is not especially be limited as long as it has a characteristic of melting at 200 degrees C. to 400 degrees C., polyamide fibers, such as 6-nylon and 6,6-nylon, polyallylate fiber, etc. may be mentioned. Among them, from a viewpoint of heat resistance and wear and abrasion resistance given to the fabric, especially a polyamide fiber is preferable.

As the melting fiber, a fiber having a melting temperature of 200 degrees C. to 300 degrees C. is more preferable. A fiber melting at temperatures lower than 200 degree C. cannot suppress calorific power when the melting fiber contacts heater flame, combustion will start before a fiber melting at temperatures exceeding 400 degree C. covers surroundings of the halogen-containing flame resistant fiber, and as a result heat-resistant improvement as whole of the fabric cannot be expected.

Compounding methods of the cellulosic fiber (b-1) and the fiber melting at 200 degrees C. to 400 degrees C. (b-2) are not especially limited, and blending, twisting, etc. may be mentioned.

A flame resistant union fabric of the present invention is obtained by co-weaving either of the fiber yarn (A) and the compound yarn (B) for a warp yarn, and another yarn for a weft yarn. Union fabric itself is a fabric excellent in design having very characteristic appearance, and especially in co-weaving of the flame resistant fiber and general non-flame resistant fibers, some certain weaving methods enable a large amount of disposition on a fabric surface of non-flame resistant fibers with excellent touch or hygroscopic property, enabling increase in commercial value of the fabric. However, union fabrics that dispose many non-flame resistant fibers to a fabric surface thereof have low flame resistance in general as compared with plain fabrics. A union fabric of the present invention obtained by co-weaving a fiber yarn (A) and a compound yarn (B), uses the compound yarn (B) obtained by compounding a cellulosic fiber (b-1) and a fiber melting at 200 degrees C. to 400 degrees C. (b-2) as non-flame resistant fibers, and thereby while maintaining high degree of flame resistance of Class M1 also in a union fabric, allows disposition of a large amount of cotton (b-1) or nylon (b-2) on the fabric surface. As a result, a fabric having excellent touch and excellent hygroscopic property, and high design property may be obtained, and furthermore maximum exhibition of both of special features of flame resistance of the fiber yarn (A), and of touch of the compound yarn (B) may be attained.

In the flame resistant union fabric, a percentage of the compound yarn (B) is not less than 30%, and preferably not less than 40% (lower limit), and not more than 70%, and preferably not more than 60% (upper limit). On the other hand, a percentage of the fiber yarn (A) is not less than 30% in the flame resistant union fabric, and preferably not less than 40% (lower limit), and it is not more than 70%, and preferably not more than 60% (upper limit).

Of course, a total of the fiber yarn (A) and the compound yarn (B) may be adjusted to be 100%.

A percentage of the compound yarn (B) of less than the lower limit in the flame resistant union fabric fails to provide sufficient flame resistance, and on the other hand, a percentage exceeding the upper limit fails to fully exhibit special feature as a flame resistant fiber of the fiber yarn (A).

Reasons that a flame resistant fiber union fabric of the present invention represents high flame resistance of Class M1 in NF P 92-503 combustion test are not yet certain, but for example, following reasons may be expected.

(1) By compounding a fiber (b-2) melting at 200 degrees C. to 400 degrees C. with a cellulosic fiber (b-1), the melting fiber (b-2) covers around the halogen-containing flame resistant fiber in a combustion test of the fabric, and as a result, heat resistance of the fabric improves, leading to resultant improvement in flame resistance of the fabric.

(2) Especially, mixing to the cellulosic fiber (b-1) of the melting fiber (b-2) (polyamide fibers, such as 6-nylon, 6,6-nylon) having high pyrolysis temperature suppresses calorific power when contacting a flame of a heater.

EXAMPLE (Flame Resistance Examination)

Evaluation of flame resistance of union fabrics was performed according to French NF P 92-503 method. The French NF P 92-503 combustion test method will briefly be described. Examined fabric is held horizontally inclined by 30 degrees, an electric heater with 500 W is brought close to the fabric, and contact with a burner flame is carried out for 5 seconds at each timing of 20 seconds, 45 seconds, 75 seconds, 105 seconds, 135 seconds, and 165 seconds after heater heating starts. Flame resistance is judged by a number of seconds in which a flame remains burning, and a distance of charring. This examination is a very severe combustion test in which contact with a burner flame is carried out simultaneously with heating by an electric heater.

Combustion of a union fabric was carried out in four directions of: warp surface side, warp reverse side, weft surface side, and weft reverse side. Judgment was performed according to following NF P 92-507 criterion.

Acceptance Criterion

M1: All flame-remaining periods in 4 directions are not more than 5 seconds

M2: In examination in four directions, at least one sheet has a flame-remaining period exceeding 5 seconds, and an average distance of charring of not more than 35 cm M3: In examination in four directions, at least one sheet has a flame-remaining period exceeding 5 seconds, and an average distance of charring of not more than 60 cm

Manufacturing Example 1

Manufacture of a Halogen-containing Flame Resistant Fiber

Acrylonitrile 52 parts, vinylidene chloride 46.8 parts, and sodium styrenesulfonate 1.2 parts were copolymerized to obtain an acrylic based copolymer. The obtained acrylic based copolymer was dissolved in acetone to obtain a solution with a concentration of 30%. Antimony trioxide 50 parts was added to the obtained copolymer 100 parts to prepare a spinning solution. The obtained spinning solution was extruded into an aqueous solution of acetone with a concentration of 38% at 25-degree C. using a nozzle having 0.07 mm of pore size, and 33000 numbers of holes, and then after washing with water the obtained filaments were dried for 8 minutes at 120 degrees C. Then the obtained filaments were drawn 3 times at 150 degrees C., and subsequently heat-treated for 30 seconds at 175 degrees C. to obtain a halogen-containing flame resistant fiber having a size of a fiber of 3 dtex. A finishing oil for spinning (manufactured by TAKEMOTO OIL & FAT CO., LTD.) were given to the obtained halogen-containing flame resistant fiber, textured to form crimps, and subsequently cut into length of 38 mm. Subsequently, a spun yarn with a metric count of No. 10 was manufactured.

Comparitive Manufacturing Example 1

Manufacture of a Halogen-containing Flame Resistant Fiber

Except for having added antimony trioxide 20 parts to the acrylic based copolymer 100 parts to prepare a spinning solution, a similar method as in Manufacturing Example 1 was repeated, a halogen-containing flame resistant fiber was manufactured, and then a spun yarn with a metric count of No. 10 was obtained.

Example 1

Manufacture of a Union Fabric

Cotton 80 parts and 6,6-nylon (melting point of 260 degrees C.) 20 parts were blended to give a total of 100 parts. Using the raw stock a spun yarn having a metric count of No. 26 was obtained. This spun yarn was used as a warp yarn with a density of 130 units/2.54 cm (1 inch) (percentage of warp yarn 55%), and the spun yarn consisting of the halogen-containing flame resistant fiber manufactured in the Manufacturing Example 1 was woven with a density of 45 units/2.54 cm (1 inch) as a weft yarn (percentage of weft yarn 45%) into a union fabric having a 5 harness satin weave.

Comparitive Example 1

Manufacture of a Union Fabric

Except having used the spun yarn consisting of the halogen-containing flame resistant fiber manufactured in the Comparative Manufacturing Example 1 as a weft yarn, similar method as in Example 1 was repeated to manufacture a union fabric having a 5 harness satin weave.

Comparitive Example 2

Manufacture of a Union Fabric

A spun yarn having a metric count of No. 26 by 100 parts of cotton was used as warp yarn with a density of 130 units/a 2.54 cm (1 inch) (percentage of warp yarn 55%), and the spun yarn consisting of the halogen-containing fiber manufactured in the Manufacturing Example 1 was woven with a density of 45 units/2.54 cm (1 inch) as a weft yarn (percentage of weft yarn 45%) into a union fabric having a 5 harness satin weave.

The obtained union fabric was evaluated for flame resistance. Table 1 represents results.

TABLE 1

| Example number | Halogen-containing fiber yarn (A) Antimony (part) | Compound yarn (B) Cellulosic fiber (b-1)/ melting fiber (b-2) | Mixing ratio (b-1)/(b-2) | Mixing ratio of halogen-containing fiber (yarn A)/ compound yarn (B) in the union fabric | Flame resistance |
|---|---|---|---|---|---|
| 1 | 50 | Cotton/6,6-nylon | 80/20 | 45/55 | M1 |
| Comparative Example 1 | 20 | Cotton/6,6-nylon | 80/20 | 45/55 | M2 |
| Comparative Example 2 | 50 | Cotton/- | 100/0 | 45/55 | M2 |

Table 1 clearly shows that a combustion test result of a union fabric consisting of a spun yarn (A) consisting of a halogen-containing flame resistant fiber including, as a flame resistant agent, antimony trioxide in a specified amount, a cellulosic fiber, and a compound yarn (B) melting at 200 degree C. to 400 degrees C., shows class M1, giving high flame resistance.

Comparative Example 1 having a low amount of antimony trioxide in the halogen-containing flame resistant fiber shows flame resistance inferior to the union fabric obtained in Example 1, giving class M2.

Comparative Example 2 without a fiber melting at 200 degrees C. to 400 degrees C. shows flame resistance inferior to the union fabric obtained in Example 1, giving class M2.

As mentioned above, it is clear that in a union fabric co-weaving a fiber yarn (A) consisting of a halogen-containing flame resistant fiber including antimony trioxide, and a compound yarn consisting of a compound yarn (B) consisting of a cellulosic fiber and a fiber melting at temperatures of 200 degrees C. to 400 degrees C., a fabric of high flame resistance classified into Class M1 can be obtained.

INDUSTRIAL APPLICABILITY

Since a flame resistant union fabric of the present invention is a union fabric having high degree of flame resistance that may passes class M1 of NF P 92-503 combustion test in France, it can develop high flame resistance also in union fabrics, such as jacquard, dobby, and satin weave.

The invention claimed is:

1. A union fabric obtained by co-weaving:

a fiber yarn (A) that has, as a principal component, a halogen-containing flame resistant fiber including 25 to 50 parts by weight of an antimony compound in 100 parts by weight of an acrylic based copolymer consisting of 30% to 70% by weight of acrylonitrile, 30% to 70% by weight of a halogen-containing vinyl based monomer and 0% to 10% by weight of a vinyl based monomer copolymerizable therewith; and a compound yarn (B) consisting of a cellulosic fiber (b-1) and a fiber melting at temperatures of 200 degrees C. to 400 degrees C. (b-2);

said fiber yarn (A) comprising 30% to 70% by weight of the union fabric and said compound yarn (B) comprising 70% to 30% by weight of the union fabric wherein the total weight of the fabric is 100%;

said co-woven fabric being flame resistant to an extent sufficient to pass France's Class M1 in the NF-P 92-503 Combustion Test.

2. The flame resistant union fabric according to claim 1, wherein the cellulosic fiber (b-1) is at least one kind selected from a group consisting of cotton, hemp, rayon, polynosic, cupra, acetate, and triacetate.

3. The union fabric according to claim 1, wherein the fiber melting at temperatures of 200 degrees C. to 400 degrees C. (b-2) is a polyamide fiber.

* * * * *